US006102534A

United States Patent [19]

Herbert

[11] Patent Number: 6,102,534

[45] Date of Patent: Aug. 15, 2000

[54] POSTAGE METER WITH REMOVABLE PRINT HEAD

[75] Inventor: Raymond John Herbert, Leigh-on-Sea, United Kingdom

[73] Assignee: Neopost Limited, Essex, United Kingdom

[21] Appl. No.: 09/070,025

[22] Filed: Apr. 30, 1998

[30] Foreign Application Priority Data

May 2, 1997 [GB] United Kingdom ..... 9709049

[51] Int. Cl.[7] ..... B41J 2/175

[52] U.S. Cl. ..... 347/86; 705/408

[58] Field of Search ..... 101/71, 91; 235/101; 705/401, 408, 410; 347/20, 21, 22, 23, 49, 50, 86, 87, 84, 85

[56] References Cited

U.S. PATENT DOCUMENTS

| | | | |
|---|---|---|---|
| 4,907,018 | 3/1990 | Pinkerpell et al. | 347/87 |
| 5,552,816 | 9/1996 | Oda et al. | 347/86 |
| 5,561,450 | 10/1996 | Brewster et al. | 347/49 |
| 5,619,239 | 4/1997 | Kotaki et al. | 347/86 |
| 5,627,577 | 5/1997 | Buican | 347/50 |
| 5,889,535 | 3/1999 | Jackson et al. | 347/22 |
| 5,901,644 | 5/1999 | Etheridge et al. | 101/71 |

*Primary Examiner*—Emanuel Todd Voeltz
*Assistant Examiner*—Thomas A. Dixon
*Attorney, Agent, or Firm*—Shoemaker and Mattare, Ltd.

[57] ABSTRACT

A postage meter includes a printing device including a removable ink supply carried by the printing device. The printing device is movable on a carriage over an area in which printing of a postage indicia is to be effected and is movable to a location beyond that area for the purpose of replacement of the ink supply. Access to the printing device to replace the ink supply is by means of a hatch in a housing of the postage meter. The printing device can be moved and from the location only when the hatch is locked closed and the construction of the carriage and the mounting thereon of the printing device is such as to inhibit access to electrical connections between the printing device and the postage meter.

9 Claims, 2 Drawing Sheets

POSTAGE METER WITH REMOVABLE PRINT HEAD

This invention relates to postage meters in which a print head utilised for printing postage indicia is removably mounted on the postage meter.

Postage meters include electronic means for carrying out accounting functions in respect of postage values which it is desired to apply to mail items by operation of a printer. The electronic means also carries out control functions for operation of the postage meter including operation of the printer. The accounting and control is carried out in a secure manner by housing the electronic means in a secure housing in order to protect the integrity of accounting data generated by the accounting means and to prevent fraudulent operation of the postage meter. It will be appreciated that it is also necessary, or at least desirable, to ensure that the printer cannot be operated to print postage indicia in respect of values for which proper accounting has not been effected. Accordingly the printer is usually housed, together with the electronic means, in the secure housing.

Previously postage meters have been provided with a drum printer or a thermal transfer printer for printing the postage indicia. With the drum printer, ink for printing the postage indicia is supplied by means of a replaceable absorbent roller containing liquid ink which rolls in contact with print dies on the print drum. With thermal transfer printers, ink is supplied as a layer on a replaceable ribbon which is fed past a thermal print head for transfer of ink to the mail items. Both the ink roller and the ink ribbon are removable from the postage meter by a user of the postage meter for replacement by a new ink roller or ink ribbon respectively. With both of these types of printer, the printer per se is maintained secure by the secure housing. In the case of the drum printer, mechanical elements for setting the printing elements of the printer are not accessible by a user of the postage meter and in the case of a thermal transfer printer, electrical connections to the print head for control and operation of the print head are protected from access thereto.

It is now proposed, instead of drum printers or thermal transfer printers, to use ink jet printing devices. Ink jet print heads are already used widely as computer output printers where security of operation thereof is neither a problem nor required. The ink jet print heads manufactured and sold for use in computer output printers comprise a module including a row of ink jet nozzles and means for ejecting selectively ink from those nozzles. The module also includes electronic circuits for operation of the ink ejection means. An ink supply cartridge to supply ink to the nozzles to replenish ink ejected from the nozzles in printing is removably mounted in the module. When the ink in the ink supply cartridge is exhausted the cartridge is removed from the module and replaced by a new ink supply cartridge. Commercially available ink jet print heads are capable of printing only over a width less than that required for printing postage indicia. Accordingly, in order to enable printing over a width sufficient for printing the postage indicia, the print head must be traversed across an area of the mail item in which the indicia is to be printed. As a result the print head needs to be connected by a flexible cable to electronic circuits of the postage meter. In order to prevent fraudulent operation of the print head the print head and the flexible cable connecting the print head to the postage meter need to be protected from unauthorized access while at the same time permitting a user of the postage meter to remove and replace the ink supply cartridge.

SUMMARY OF THE INVENTION

According to the invention a postage meter includes a printing device traversable across an area in which a postage indicium is to be printed and including ink supply means movable with the printing device; and wherein means for traversing the printing device is operable to move the printing device to a location beyond said area; and including a hatch in a secure housing of the postage meter adjacent said location; said hatch being openable only when said printing device is in said location to permit removal and replacement of said ink supply means and said postage meter being inoperative to print postage indicia when the hatch is not locked in a closed position.

BRIEF DESCRIPTION OF THE DRAWING

An embodiment of the invention will be described hereinafter by way of example with reference to the drawings in which.

DESCRIPTION OF THE PREFERRED EMBODIMENT

Figure 1:
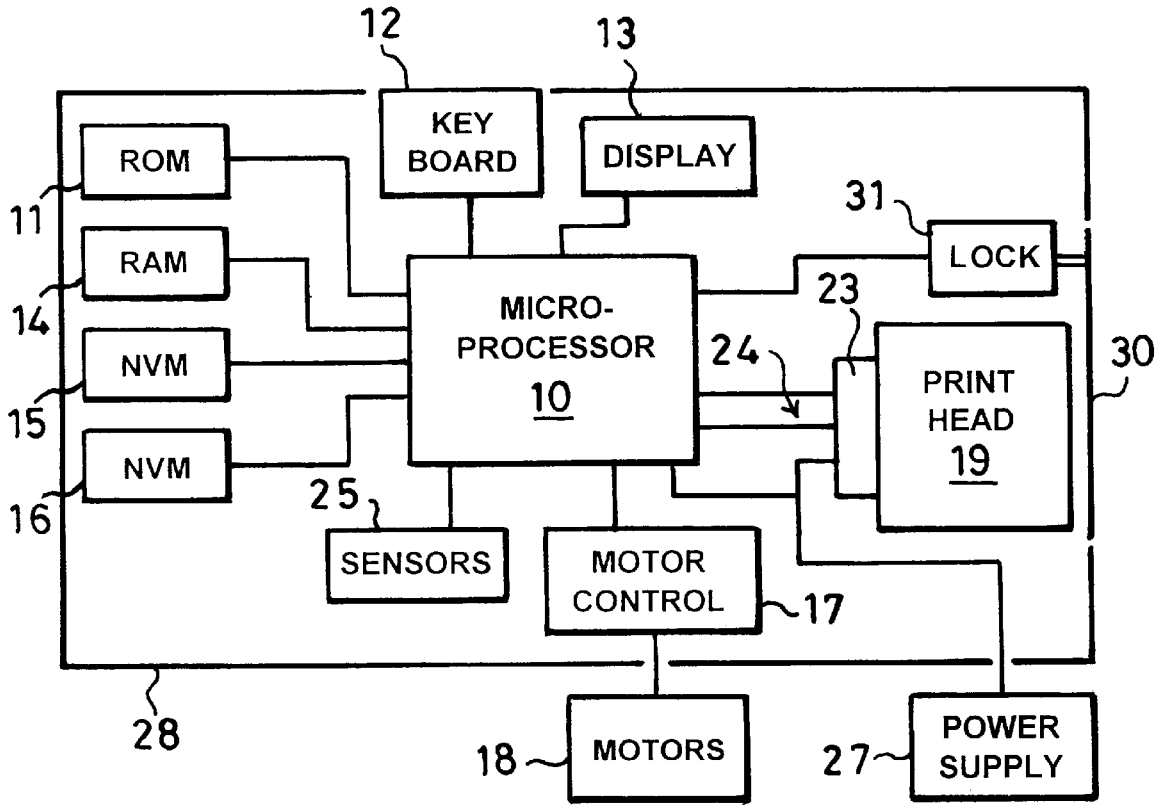
FIG. 1 is a block circuit diagram of a postage meter.

Referring first to FIG. 1 of the drawings, the postage meter includes electronic accounting and control means comprising a micro-processor 10 operating under program routines stored in a read only memory (ROM) 11. A keyboard 12 is provided for input of commands and data by a user and a display 13 is provided to enable display of information to the user. A random access memory (RAM) 14 is provided for use as a working store for storage of temporary data during operation of the postage meter. Non-volatile duplicated memories 15, 16 are provided for the storage of critical data relating to use of the postage meter and which is required to be retained even when the postage meter is not powered. The microprocessor 10 carries out accounting functions in relation to use of the postage meter for franking mail items with amounts of postage charges applicable to handling of the mail items by the postal authority or another carrier. Accounting data relating to use of the postage meter for printing franking indicia representing postage charges for mail items and any other critical data to be retained is stored in the non-volatile memories 15, 16. The accounting data includes a value of credit, an accumulated total of value used by the meter in franking mail items, a count of the number of mail items franked by the meter and a count of the number of mail items franked with a postage charge in excess of a predetermined value. The value of credit may be a value of credit available for use by the meter and stored in a descending credit register. The accumulated total value used by the meter is stored in an ascending tote register, the count of items is stored in a piece count register and the count of items franked with a postage charge in excess of a predetermined value is stored in a large items register. Alternatively, if desired, instead of a descending register storing a value of credit available for use by the meter, a total value of credit entered into the meter may be stored in an ascending credit register.

As is well known in the postage meter art, each of the registers referred to hereinbefore for storing accounting data is replicated in order to enable integrity of the accounting data to be maintained even in the event of a fault or termination of power to the meter during a franking operation. Two replications of each of the registers are provided in each of the memory devices 15, 16.

Figure 2:
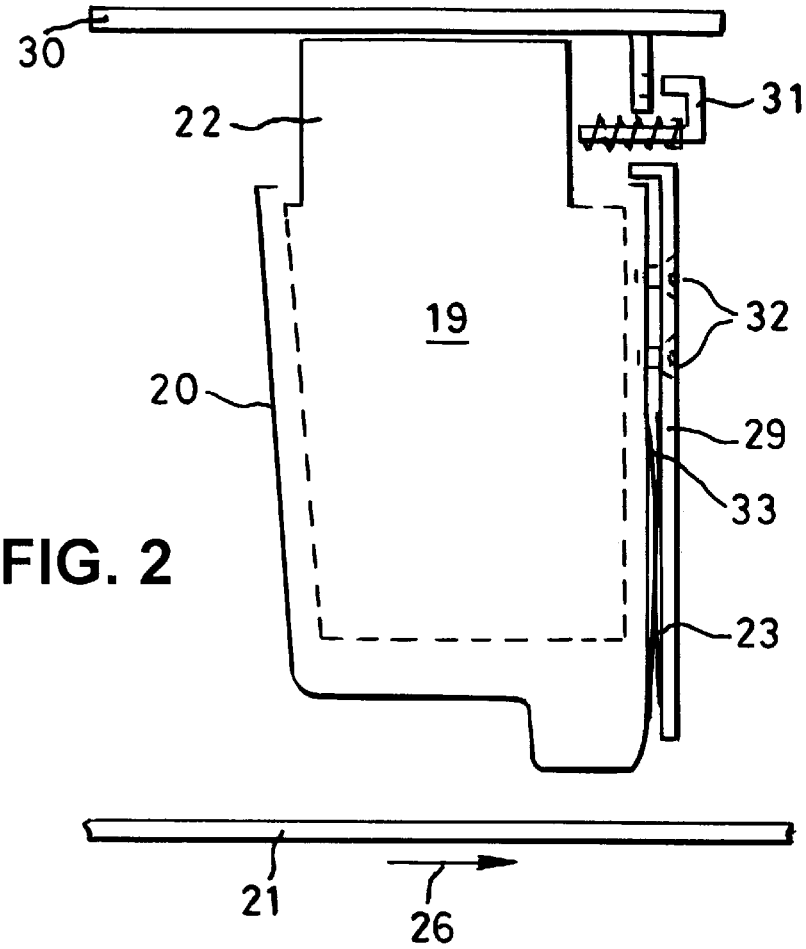
FIG. 2 illustrates a construction of postage meter.
Figure 3:
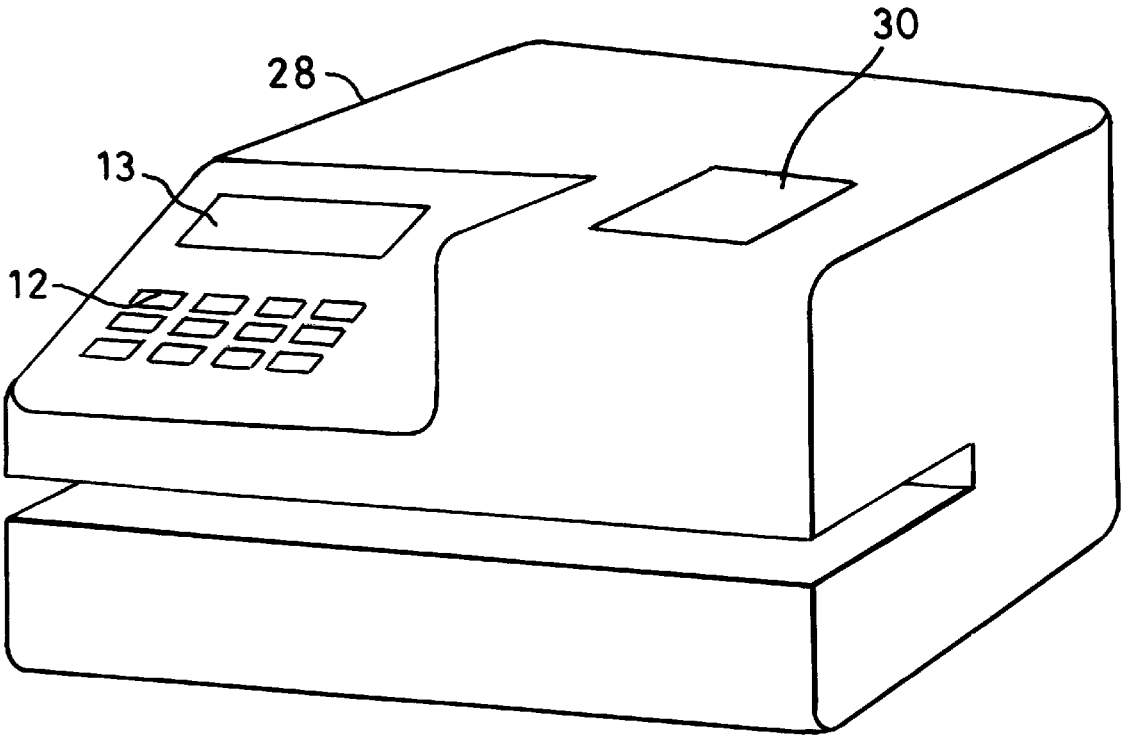
FIG. 3 illustrates a mounting for a print head and access to an ink supply cartridge.

A motor controller 17 is controlled by the microprocessor 10 to control operation of motors 18 driving feeding means (not shown) for feeding a mail item past a digital print head 19. The digital print head is preferably an ink jet print head constructed as a module 20 as shown in FIG. 2. The ink jet print head module 20 includes a plurality of ink ejection nozzles (not shown) from which ink may be ejected selectively by means of the operation of electronic circuits in the module onto the surface of a mail item 21. The module also contains a removable ink supply cartridge 22 to replenish ink ejected from the nozzles. The module 20 is connected to the microprocessor 10 by means of a plurality of contact pads 33 mating with corresponding contact pads 23 connected to a flexible cable 24, for example a flexible ribbon cable having a plurality of conductive tracks.

Sensors 25 are provided to sense and monitor feeding of the mail item in the direction of arrow 26 past the ink nozzles of the print head. The sensors provide signals to the microprocessor to enable the microprocessor to control feeding of the mail item and to output signals via the flexible cable 24 to selectively operate the circuits in the print head module to eject ink droplets from the nozzles at appropriate times as the mail item is fed past the nozzles of the print head.

Electrical power is supplied to the electronic circuits of the postage meter including the microprocessor, the print head module and the motor control from a power source 27.

It will be appreciated, as is well known in the postage meter art, that the postage meter must operate in a secure manner and be protected from attempts to use the meter fraudulently for example by utilizing the postage meter to print franking indicia on mail items for which no corresponding postage charge has been accounted for by the accounting means. Accordingly those parts of the postage meter required to be secured against unauthorized tampering are housed in a secure housing 28.

In so-called prepayment operation of a postage meter, each time a franking operation is to be performed, the microprocessor carries out a routine in which a determination is made as to whether the value of credit in the credit register in NVMs 15, 16 is sufficient to permit the franking operation in respect of the required postage charge for a mail item to be performed. If the value of credit in the credit register is sufficient, the franking operation is continued and the accounting data in the registers is updated to account for the postage charge and the franking indicia is printed. However if the value of credit in the credit register is not sufficient to permit the franking operation in respect of the required postage charge to be performed, the operation is terminated and the franking indicia is not printed. Where a value of credit available for use in franking is stored in a descending register, the check as to sufficiency of the credit available is effected by a determination of whether the postage charge is less than the credit value. Where a total value of credit is stored in an ascending credit register the check as to sufficiency of credit is effected by a determination of whether the total value of credit is at least equal to the sum of the postage amount and the accumulated total value in the tote register.

Commercially available ink jet print heads are able only to print over a relatively narrow width and this width is less than the required height of a postage indicia to be printed on the mail items. Therefore the print head module 20 is mounted on a carriage 29 movable parallel to the surface of the mail item in a direction perpendicular to the direction of feed of the mail item, i.e. perpendicular to the direction of arrow 26. During an operation to print a postage indicium on the mail item, the carriage and hence the print head is traversed across the mail item and droplets of ink are ejected selectively from the nozzles of the print head in a series of printing cycles as the mail item is fed past the print head in the direction of the arrow 26. Accordingly printing of the required printed indicium is effected printing cycle by printing cycle until the entire indicium is printed.

As described hereinbefore, a removable ink supply cartridge 22 is mounted in the print head module 20 includes an ink supply. Accordingly when the ink in the cartridge is exhausted, the cartridge 22 must be removed and replaced by a new cartridge full of ink. Therefore access by a user of the postage meter to the cartridge must be provided to permit the required removal of the used cartridge and replacement with a new cartridge. It is desirable in providing such access that measures are taken to ensure that unauthorised access cannot be had to the print head module, in particular the contact pads 33 of the print head module, the corresponding contact pads 23, or to the flexible cable 24.

Access to the ink cartridge 22 is provided by means of a hatch 30 in the housing 28 of the postage meter. The hatch is located such that the cartridge is accessible through the hatch opening only when the print head module 20 is moved by the carriage 29 to a parking location beyond the range of movement of the print head module required for printing postage indicia. When the print head has been moved to this parking location, a lock 31 may be released under control of the microprocessor 10 to enable the hatch to be opened and thereby enable replacement of the ink cartridge. The sensors include a sensor responsive to the state of the hatch, for example that the hatch is in a fully closed and locked position. Operation of the postage meter to print postage indicia is inhibited while the lock is released and while the hatch is open.

The construction of the carriage and the mounting of the print head module thereon is such as to prevent unauthorized access to the electrical connections between the print head module and the postage meter. For example the carriage may include a member extending wholly across the contact pads 33 of the module and the corresponding contact pads 23 on the ribbon cable 24 so that both sets of contact pads are disposed between the member of the carriage and the module whereby access to these contacts pads is inhibited. Also the print head module is mounted to the carriage in such a manner that the access through the hatch opening does not permit removal of the module. For example the print head module may be secured to the carriage by means of screws 32 which are inaccessible through the hatch opening. Interlocks are provided to ensure that the print head module cannot be moved to the operative printing position if the lock is released or if the hatch is not fully closed. The interlocks also ensure that the hatch can be opened only when the print head module has been moved to the parking location. Preferably the lock is released by operation of a solenoid or motor controlled by the microprocessor. When a user wishes to replace the ink cartridge, the user operates a key or keys of the keyboard to initiate a cartridge changing routine. In this routine the microprocessor controls a carriage motor to move the print head module to the parking location and when, and only when, the module is in the parking location the microprocessor operates means permitting release of the lock or means to release the lock. After replacement of the cartridge, the user closes the hatch and initiates an operational routine in which the microprocessor controls the carriage motor to move the print head module to an operational printing position.

Hereinbefore the postage meter is described as including means to feed the mail item past the nozzles of the print head and to displace the print head in a direction perpendicular to the direction of feed of the mail item to enable an indicia of greater extent than the extent of the nozzles of the print head to be printed. In an alternative construction, the mail item may be stationary in the postage meter and the print head is moved along a path such as to traverse two adjacent portions of an area on the stationary mail item in which indicia is to be printed. Accordingly in such an alternative construction no means are provided for feeding the mail past the print head nozzles and the motors 18 are utilised for moving the print head so as to traverse the area of the mail item and to displace the head in a direction perpendicular to the direction of traverse.

It will be appreciated that the postage meter is so constructed that opening of the hatch 30 does not permit access to the microprocessor 10, memories 11, 14, 15 and 16 and other accounting and control circuits of the postage meter. If desired, in order to prevent access to the accounting and control circuits through the hatch 30 a shield or wall may be provided, the shield or wall extending between a region in the secure housing 28 in which the accounting and control circuits are located and a region in the secure housing in which the print head 19 is located.

We claim:

1. A postage meter including a printing device traversable across an area in which a postage indicium is to be printed and including ink supply means movable with the printing device; and wherein means for traversing the printing device is operable to move the printing device to a location beyond said area; and including a hatch in a secure housing of the postage meter adjacent said location; lock means operable to lock the hatch in a closed position; said hatch being openable only when said printing device is in said location to permit removal and replacement of said ink supply means and said postage meter being operative to print postage indicia only when the hatch is locked in a closed position.

2. A postage meter as claimed in claim 1 wherein the printing device comprises a module mounted on a carriage for traversal of the area in which the postage indicium is to be printed and wherein the ink supply means comprises a cartridge containing ink and removably mounted on the module.

3. A postage meter as claimed in claim 2 including electronic control means and electrical connections between the electronic control means and the printing device and wherein the construction of the carriage and the mounting thereon of the module prevents access to the electrical connections via the hatch.

4. A postage meter as claimed in claim 3 wherein the electrical connections are located between the module and an element of the carriage whereby said connections are inaccessible.

5. A postage meter as claimed in claim 2 wherein the construction of the carriage and the manner of mounting hereon of the module prevents removal of the module via access thereto through the hatch when opened.

6. A postage meter as claimed in claim 5 including means securing the module to the carriage; said securing means being so located as to be inaccessible through the hatch when opened.

7. A postage meter as claimed in claim 1 including means operative to prevent movement of the printing device to the location beyond the area in which postage indicia are to be printed if the hatch is not fully closed.

8. A postage meter as claimed in claim 7 including means operative to permit opening of the hatch from a closed position only if the printing device is in the location.

9. A postage meter as claimed in claim 7 including means operative to permit movement of the printing device from the location to the area in which printing of postage indicia is to be effected only if the hatch is fully closed.

* * * * *